United States Patent [19]

Martinez

[11] 4,400,899

[45] * Aug. 30, 1983

[54] ALBUM

[75] Inventor: Eugene E. Martinez, Irvington-On-Hudson, N.Y.

[73] Assignee: Robert H. Reibel, Croton-on-Hudson, N.Y.

[ * ] Notice: The portion of the term of this patent subsequent to Aug. 15, 1995 has been disclaimed.

[21] Appl. No.: 180,596

[22] Filed: Aug. 25, 1980

Related U.S. Application Data

[63] Continuation-in-part of Ser. No. 767,503, Feb. 10, 1977, Pat. No. 4,106,230, and Ser. No. 928,878, Jul. 28, 1978, abandoned.

[51] Int. Cl.[3] ..... B42F 17/22; G09F 19/00; A47G 1/06; G09F 7/12

[52] U.S. Cl. ..... 40/391; 40/534; 40/394; 40/158 R; 40/373; 40/594

[58] Field of Search ..... 40/158 R, 159, 405, 40/158 A, 158 B, 360, 537, 534, 391, 594, 359, 373, 394; 428/121

[56] References Cited

U.S. PATENT DOCUMENTS

| | | | |
|---|---|---|---|
| 1,604,028 | 10/1926 | Dinkler | 40/534 |
| 2,096,559 | 10/1937 | Riley | 428/121 |
| 2,228,177 | 1/1941 | Moore | 40/534 |
| 2,304,158 | 12/1942 | Flood | 40/534 |
| 2,610,421 | 9/1952 | Horn | 40/158 R |
| 3,043,734 | 7/1962 | Porter | 40/359 |
| 3,620,891 | 11/1971 | Jones, Sr. | 40/360 |
| 3,885,768 | 5/1975 | Frye | 40/594 |
| 4,106,230 | 8/1978 | Martinez | 40/158 R |
| 4,232,463 | 11/1980 | Spees | 40/373 |

*Primary Examiner*—Gene Mancene
*Assistant Examiner*—Michael J. Foycik
*Attorney, Agent, or Firm*—Kirschstein, Kirschstein, Ottinger & Cobrin

[57] ABSTRACT

The album has an imperforate backing member. Attached to the backing member are a plurality of transverse, parallel rectilinear strips each coated at its underside with adhesive. The strips are each adhered to the top face of the backing member, each strip having a section inclined away from and free of the top face of the backing member. Adhered to each of the inclined sections of the strips is a bent-back section of a transverse release ribbon. The ribbons have extending tab portions which may be grasped by fingers of a user to pull the release ribbon off and away from the strip to uncover the adhesive-coated inclined section or portion of the strip. The ribbons and inclined portions of the strip form adhesive-free wedge shaped spaces into which photographic snapshots may be inserted in predetermined overlapping relationship. After insertion of a snapshot the ribbon is pulled off to expose the adhesive coating on the underside of the associated strip so that the snapshot may be adhered to the uncovered portion of the strip. The snapshots can each be folded 180° from a position exposing the picture of the photograph to a position in which the picture is hidden at the underside of the photograph. The extending tab portion of each release ribbon may or may not overlie the strip next adjacent thereto in a direction toward the upper end of the backing member. An adhesive coating on the bottom face of the backing member permits the latter to be adhered to an album page.

14 Claims, 16 Drawing Figures

ALBUM

CROSS-REFERENCE TO RELATED APPLICATIONS

This application is a continuation-in-part of my copending U.S. patent applications, Ser. No. 767,503, filed Feb. 10, 1977, for "Photo Album," and now allowed U.S. Pat. No. 4,106,230, and Ser. No. 928,878 filed July 28, 1978 and now abandoned for "Album".

BACKGROUND OF THE INVENTION

1. Field of the Invention

This invention generally relates to albums for displaying sheet-like materials and, more particularly, photographic snapshot albums.

2. Description of the Prior Art

It is known to provide a set of hinges which will permit a plurality of photographs to be mounted on any one page of an album. Each hinge has two adhesive-coated sections protected by a cover sheet. A user must first pull the cover sheet from both coated sections, then adhere one section to a backing sheet, and thereupon, adhere a photograph to the other coated section.

However, although such hinges are generally satisfactory for their intended purposes, they have not proven to be altogether satisfactory in practice. The hinges are provided as separate members and may thus be easily misplaced. Once the cover sheet has been removed, each hinge must be accurately positioned and aligned not only on the backing sheet, but also on the photograph. Moreover, the photograph must be attached soon after the cover sheet has been separated from the hinge.

SUMMARY OF THE INVENTION

1. Objects of the Invention

Accordingly, it is the general object of the present invention to overcome the aforementioned drawbacks of the prior art.

Another object of the present invention is to eliminate the prior art problems associated with misplacing hinges.

Still another object of the present invention is to eliminate the prior art mandatory requirement of accurately mounting and aligning photographs in preselected positions on a backing sheet.

An object of the present invention is to provide an album comprising a backing member or backboard, adhesive coated strips each adhered at one coated area of each strip to the backing member, a release ribbon having one portion coated with release material and adhered to another adhesive coated area of each of the strips, and provided with a pull tab adapted to be grasped to permit pulling off the release ribbon while permitting the strip to remain adhered to the backing member and to expose another coated area of the strip, so that a photographic snapshot can be adhered to the exposed coated area.

Another object of the present invention is to provide an album in which the adhesive strips are parallel and each adhesive strip has one portion adhered to the backing member, and in which each ribbon has one portion adhered to the swing-away portion of the strip and comprising a pull tab to permit the ribbon to be pulled off the strip to expose the adhesive surface of the swing-away portion of the strip and allow one end portion of a photographic snapshot to be adhered to the exposed adhesive surface of the strip.

Still another object of the present invention is to provide an album in which the pull tab of one release ribbon overlaps the adjacent strip in the direction towards the upper end of the backing member.

Another object of the present invention is to provide an album in which the backboard is covered partially by adhesive coated strips and release ribbons attached to the strips, an upper portion of said backboard being blank so that the photographic snapshot which is attached to the uppermost strip on the backboard will overlie the blank portion.

A further object of the present invention is to provide an album in which the attached photographic snapshots can all be folded upwardly, so that the pictures on the snapshots face forwardly, and in which the photographic snapshots can be all folded downwardly so that the pictures on the snapshots are hidden.

A still further object of the present invention is to provide a durable album which will be relatively inexpensive to manufacture, easy to manipulate, and which will be practical and efficient to a high degree in use.

2. Features of the Invention

In keeping with these objects and others which will become apparent hereinafter, one feature of the invention resides, briefly stated, in an album for displaying sheet-like articles such as photographs and the like, which comprises a backing member having opposite major sufaces, and a group of elongated rectilinear strips arranged on one of the surfaces of the backing member. Each strip includes a stationary section firmly anchored in fixed position on said one backing surface against a pulling removal force of a predetermined magnitude, and a movable section connected to the stationary section and free of the backing member. The movable section has opposite surfaces. The strip also includes a rectilinear hinge hingedly interconnecting the sections and operative for swinging each movable section relative to its respective stationary section about a rectilinear folding axis which extends lengthwise of the respective strip intermediate the respective sections between a display position in which one side of the photograph is displayed, and a flipped-over position in which the opposite side of the photograph is displayed.

The album further comprises adhesive means located on one of the surfaces of the movable section. The adhesive means is preferably a pressure-sensitive adhesive coating which is adhered to said one surface of the movable section against a pulling removal force of a given magnitude.

The album still further comprises a plurality of pull ribbons each associated with and adjacent to a different respective strip on said one backing surrace. Each pull ribbon includes a peel-off section adhered to said one surface of the movable section on which the adhesive means is located, and a handle section connected to and extending from the peel-off section. The peel-off section is adhered to the adhesive means against a pulling removal force which is of a magnitude less tha either said predetermined magnitude or said give magnitude. The handle section is manually grippable so that a user may grasp and pull each handle section and concomitantly pull the associated peel-off section from the associated movable section, without pulling the associated strip off the backing member, and without detaching the adhesive means from said one surface of the movable section, to thereby expose the adhesive means on said one surface of the movable section and permit a user to manually attach to the exposed adhesive means the photograph to be displayed in either of the aforementioned positions.

Each ribbon and its associated movable sections define an adhesive-free wedge-shaped space into which an edge of a photographic snap shot may be inserted up to the apex of the wedge so that it is in a predetermined position. The apices of the wedges are parallel and progressively laterally offset so that the snap shots are overlapping. After a snap shot is thus inserted the associated pull ribbon is peeled off to expose the adhesive means on the undersurface of the movable section which then is pressed against the snapshot to adhere thereto.

The above-described invention eliminates the problems previously discussed which are associated with the prior art. By firmly anchoring the strips on the backing member, the hinges will no longer be misplaced, and the requirement of the prior art to accurately position and align the hinges on the backing sheet by eye is no longer necessary. Moreover, the provision of pull ribbons having peel-off sections and manually-grippable handle sections permits the user to manually attach a photograph in a simple, quick and reliable manner.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
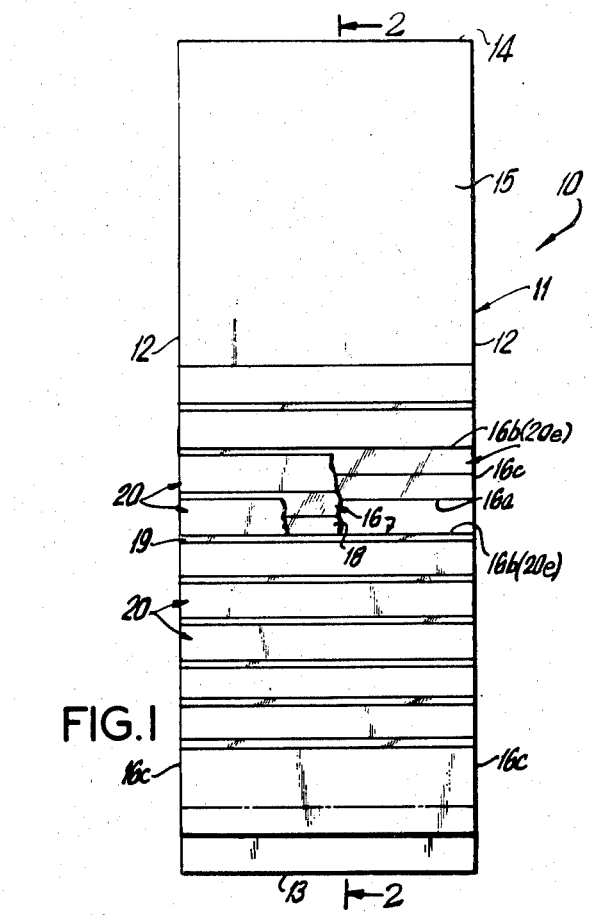
FIG. 1 is a top plan view of an album embodying the invention
Figure 2:
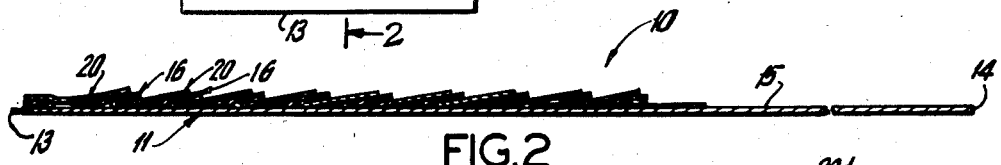
FIG. 2 is a cross-sectional view taken on line 2—2 of FIG. 1.

Referring now in detail to the drawings and particularly to FIGS. 1 and 2 thereof, reference numeral 10 designates a photographic snapshot album embodying the invention. The album 10 comprises a backboard or base 11, preferably of elongated rectangular shape, having longer parallel side edges 12, a shorter lower edge 13 and upper edge 14.

The backing member or backboard 11 may comprise cardboard or other suitable stiff or semi-stiff thin material, or paper or backing means.

Attached to the upper major surface 15 of the backboard 11 are a plurality of parallel rectilinear strips 16 of flexible sheets of cloth or paper or plastic film such as Teflon, fluorocarbon, polyester or polypropylene. The strips 16 may be clear or colored or opague and extend transversely of the backboard and are as long as the width of the backboard. Each strip has a lower end edge **16*a*, an upper end edge 16*b* and end edges 16*c* registering with the side edges 12 of the backboard. Strips 16 are of uniform width. The strips 16** may be vacuum plated or printed or may comprise foil, aluminum or lead.

The undersurface of each strip is coated with a coating 17 of pressure-sensitive adhesive such as acrylic-based adhesive or latex, or acrylate, natural rubber or synthetic resins.

Substantially the lower half or stationary rectilinear section of each strip 16 is adhered by the pressure-sensitive adhesive coating 17 to the upper surface 15 of the backboard. The stationary section is firmly anchored in fixed position on the upper surface 15 against a pulling removal force of a predetermined magnitude. The stationary section need not be adhesively anchored by coating 17, but may be anchored to the backboard by mechanical stitching, heat and pressure sealing, electrical heat fusion and other joining techniques. Edge **16*b* of each strip may substantially coincide or register with the edge 16*a* of the next adjacent strip 16, in a direction toward the upper end of the backboard. The area or stationary section of each strip 16 which is adhered to the backboard is designated in the drawing by numeral 18. The movable rectilinear section or portion of the strip 16 which extends from the portion 18 and designated by numeral 19 inclines away from surface 15** and is free of the backboard.

Attached to each strip 16 is a release ribbon or piece of tape 20 which may be made of paper or other flexible sheet material. Ribbons 20 are of uniform width and extend transversely of the backboard and are coextensive with the strips 16, but of greater width than the strips. The ribbons may comprise plastic, polyethylene, with or without silicone coating, or parchment with Quilon release or glassine paper with or without silicone. Quilon is an inert coating derived from a chrome complex of chemicals.

Ribbons 20 may each be coated at their undersides **20*a* with a release coating, not shown, but which may comprise silicone. Each ribbon 20** is folded on itself longitudinally to form a narrower or peel-off section 20*b* folded about a rectilinear fold edge 20*c*, against a wider or handle section 20*d*. The outer edge 20*e* of section 20*b* registers with edge 16*b* of the strip 16 The section 20*b* of ribbon 20 is adhered to movable section 19 of strip 16 by coating 17. The coating 17 adheres to the movable section against a pulling removal force of a given magnitude. The peel-off section adheres to coating 17 against a pulling removal force of a magnitude less than either said predetermined or said given magnitude. Section 20*d* of the ribbon 20 overlies the next adjacent strip 16. The extending portions 20*d* of ribbons 20 constitute pull tabs which may be grasped between fingers of a user to pull off the ribbon and expose the adhesive 17 at the underside of portion 19 of the strip to which the ribbon was adhered.

Because of the presence of the release coating at the undersurface 20*a* of the ribbon, the ribbon can be pulled off the strip while the strip remains adhered and anchored to the backboard 11 by reason of the adhesive coating 17 on section 18 of the strip. If the portion of the area of the ribbon adhered to the strip is less than the area of the strip adhered to the backing member or backboard 11, the release material on the ribbon may be omitted.

As pointed out above each ribbon and its associated movable sections define an adhesive-free wedge-shaped space into which an edge of a photographic snap shot may be inserted up to the apex of the wedge so that it is in a predetermined position. The apices of the wedges are parallel and progressively laterally offset so that the snap shots are overlapping. After a snap shot is thus inserted the associated pull ribbon is peeled off to expose the adhesive means on the undersurface of the movable section which then is pressed against the snapshot to adhere thereto.

It will be noted that the strips 16 and ribbons 20 do not cover the entire surface of the backboard 11. An upper and lower end portion of the backboard is left without strips and ribbons, for the purpose hereinafter appearing.

As shown in FIG. 2, the lowermost strip 16 may be folded over in half with movable portion 19 thereof overlying stationary portion 18 thereof, and the ribbon 20 attached to portion 19 is substantially flattened out to produce a neat lower end to the album.

Figure 3:
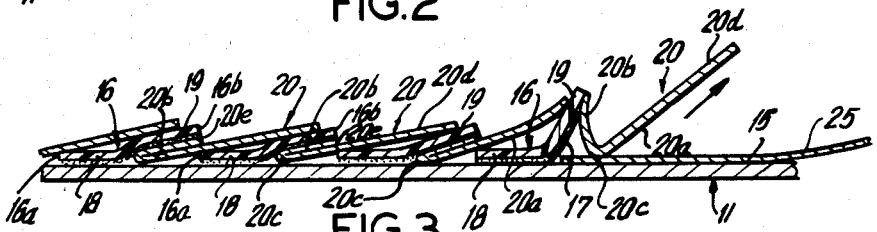
FIG. 3 is a partial enlarged view of the structure of FIG. 2 and showing an end release ribbon partially pulled off an adhesive strip to which it was adhered.
Figure 4:
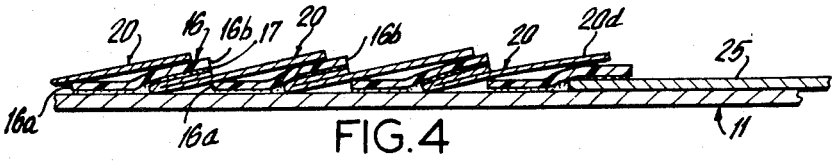
FIG. 4 is a view similar to FIG. 3 but showing a photographic snapshot adhered to the portion of the adhesive strip from which the release ribbon of FIG. 3 was pulled off.

In FIG. 3, the uppermost ribbon 20 is shown being pulled off the strip to which it was adhered. After the ribbon is removed and the adhesive 17 on section 19 is exposed, the lower end portion of a photographic snapshot 25 may be adhered to the exposed adhesive by pressing the lower end portion to the exposed adhesive as shown in FIG. 4. The snapshot 25 then lies flat on the upper blank portion of surface 15 as shown in FIG. 4.

After one snapshot is attached, another snapshot can be attached by thereafter pulling off the ribbon 20 next to the one that was first removed, and pressing the lower edge portion of another snapshot to the exposed adhesive 17 on the section 19 of the next adjacent strip 16. This action can be repeated until all ten strips 16 have snapshots attached thereto make a full album.

Figure 5:
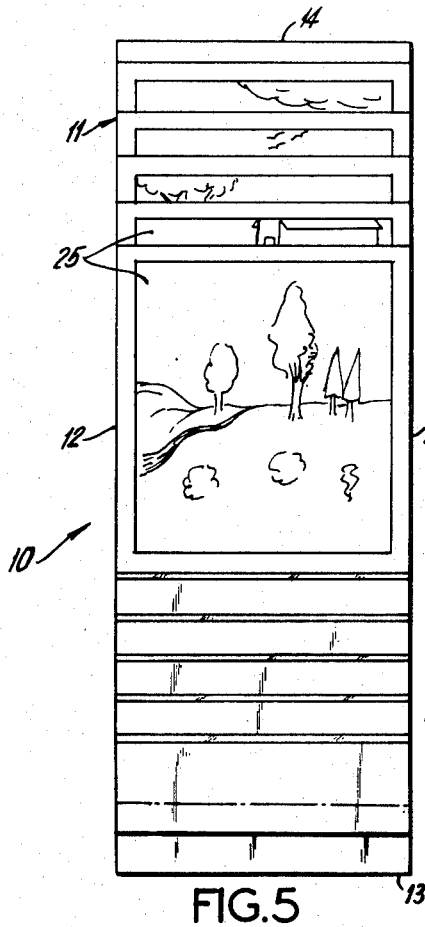
FIG. 5 is a view similar to FIG. 1, but with five photographic snapshots attached.
Figure 6:
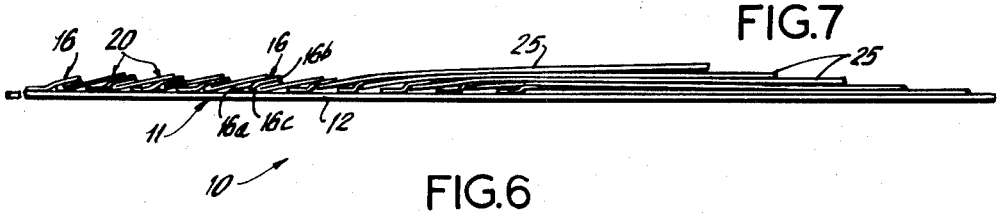
FIG. 6 is a side view of the structure of FIG. 5 looking toward the right edge of the structure of FIG. 5.

In FIGS. 5 and 6, the album is shown with only five snapshots attached.

Figure 8:
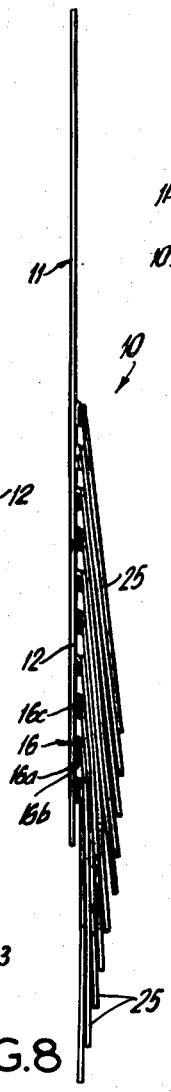
FIG. 8 is a side view of the structure of FIG. 7 looking toward the left edge of the structure of FIG. 7.
Figure 7:
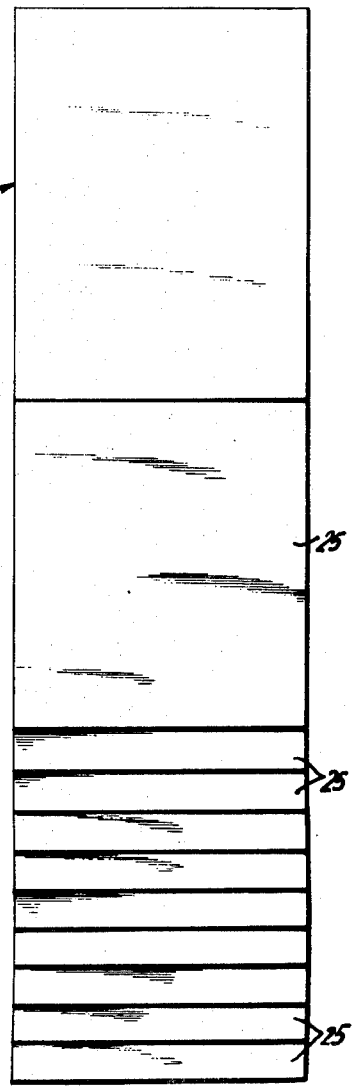
FIG. 7 is a top plan view of an album embodying the invention with ten snapshots attached and all folded down so that the pictures in the snapshots are hidden.

In FIGS. 7 and 8, all ten snapshots are attached, but the snapshots are folded down so that the pictures on the snapshots are hidden from view.

It will be noted that the adhesive 17 on section 18 of each strip 16 creates a stronger attachment between the strip 16 and the backboard 11 than the attachment of section or portion 20*b* of ribbon 20 to the adhesive 17 on section 19 of the strip.

The reason that this is so, is because the release coating on the attached surface of section 20*b* of the ribbon makes the attachment easier to break. Thus, the ribbon can be readily pulled off the strip 16, while the strip remains securely attached to the backboard.

The clear plastic strips 16 are readily foldable about the folds or folding axes 16*c* which extend lengthwise of the respective strip intermediate its respective sections between a display position in which one side of the photograph is displayed (see FIGS. 5 and 6), and a flipped-over position in which the other side of the photograph is displayed (see FIGS. 7 and 8). Each fold 16 constitutes a hinge means which can withstand many foldings and unfoldings without tearing or weakening, because of the nature of the material of which the strips are made.

Figure 9:
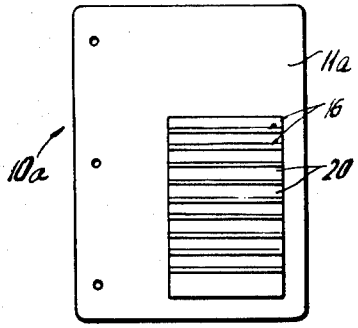
FIG. 9 is a top plan view of a modified form of the invention.

In FIG. 9 there is shown an article 10*a* embodying another form of the invention, in which the backing member or backboard 11 is replaced by a sheet of paper 11*a* which may be a page of a loose leaf notebook. The strips 16 and ribbons 20 may be applied the same way as in FIGS. 1–8, but only on a portion of the sheet 11*a*.

Figure 10:
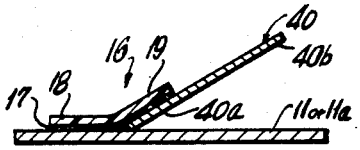
FIG. 10 is a partial cross-sectional view illustrating another modified form of the invention.

In FIG. 10, the backing member 11 or 11*a* has strips 16 adhered to the backing in the same way as they are adhered in FIGS. 1–8. Thus, each strip 16 has a portion 18 adhered to the backing member, and a portion 19 swingable away from the backing member and also coated with pressure-sensitive adhesive. However, in FIG. 10, the ribbon 40 is not folded, but has one portion 40*a* adhered to coated portion 19 of strip 16, and an extending portion 40*b* projecting beyond the strip 16 and comprising a pull tab to be grasped to pull the ribbon sideways off the strip and expose the adhesive coated portion 19 of the strip so that a snapshot can be adhered thereto. Thus, ribbon 40 is in one plane. The strips and ribbons are repeated as in FIGS. 1–8.

Figure 11:
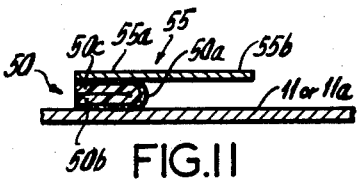
FIG. 11 is a partial cross-sectional view of still another modified form of the invention.

In FIG. 11, the backing 11 or 11*a* has folded strips 50 attached thereto. Each strip 50 is coated on one side with pressure-sensitive adhesive and is folded lengthwise about a fold 50*a* to form a bottom section 50*b* adhered to the backing member, and a top section 50*c* folded over said bottom section. A flat ribbon 55 has one portion 55*a* adhered to section 50*c*, and a portion 55*b* extending beyond the fold 50*b* to constitute a pull tab for pulling the ribbon 55 off the strip 50. The portions of ribbons 40 and 55 adhered to the strips 16, 50, respectively, may be coated with release material or the sections of the ribbons adhered to the strips may be of smaller area than the portions of the strips adhered to the backing member, thereby to permit the ribbons to be peeled sideways off the backing member readily and without pulling the strips off the backing member.

Figure 12:
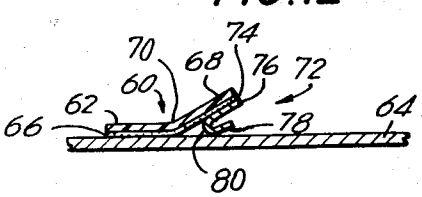
FIG. 12 is a partial cross-sectional view illustrating yet another modified form of the invention.

Turning now to FIG. 12, a single flexible strip 60 includes a stationary section 62 firmly anchored on backing member 64 by adhesive coated portion 66 which is located at the underside of section 62, a movable section 68 connected to stationary section 62, and hinge 70 operative for swinging section 68 relative to section 62 as described above. Adhesive coating portion 74 is located at the underside of section 68 and is retained thereon with an adhesive bond sufficient to resist a pulling removal force of a given magnitude. Pull ribbon 72 includes a peel-off section 76 which is adhered to the adhesive portion 74 at the underside of movable section 68 against a pulling removal force of a magnitude less than said given magnitude, and a manually grippable handle portion 78 which is connected to and folded under section 76 at fold 80. Handle section 78 extends away from fold 80 for a distance which is less than the distance which movable section 68 extends away from hinge 70. This latter feature is in contrast to the embodiment of FIG. 4 for example, wherein handle section 20*d* extends beyond the respectively associated movable section 19.

Figure 13:
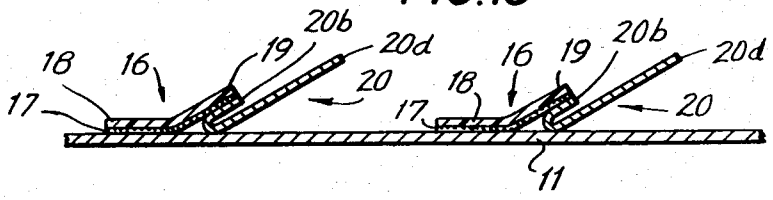
FIG. 13 is a view similar to FIG. 4 but showing the successive pairs of strips and ribbons in spaced apart non-overlapping relationship.

Turning now to FIG. 13, two pairs of strip and ribbon combinations are mounted on a backing member 11 in spaced apart relationship. Each strip and ribbon pair combination is identical in structure and function to the strip and ribbon combinations shown in the embodiment of FIGS. 1–4. However, it will be noted that no portion of any one strip and ribbon pair combination of FIG. 13 overlaps any portion of the next successive strip and ribbon pair combination. Put another way, the successive pairs of strip and ribbon combinations are widely spaced apart of each other so that no overlap exists whether the movable section of any selected pair is swung to either its display position or its flipped-over position. It will be further understood that the aforementioned feature of widely spacing the strip and ribbon pair combinations apart of each other may be utilized not only for the strip and ribbon pair combinations of FIGS. 1–4, but may equally well be employed for any strip and ribbon pair combination disclosed herein.

Figure 14:
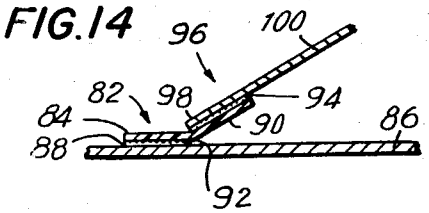
FIG. 14 is a partial cross-sectional view illustrating still another modified form of the invention.

Turning now to FIG. 14, a flexible strip 82 includes a stationary section 84 firmly anchored on backing member 86 by adhesive coating portion 88 which is located on the underside of section 84, a movable section 90 hingedly connected to section 84, and hinge 92 operative for swinging section 90 relative to section 84 as described above. Adhesive coating portion 94 is located at the upper side of section 90 in contrast to the earlier mentioned embodiments, and is retained thereon with an adhesive bond sufficient to resist a pulling removal force of a given magnitude. Pull ribbon 96 includes a peel-off section 98 which is adhered to the adhesive portion 94 at the upper side of section 90 with an adhesive bond sufficient to resist a pulling removal force of a magnitude less than said given magnitude, and a manually grippable handle section 100 which is connected to and is in planar registry with section 98. In operation, a user will grasp and pull the handle section 100 in a sideways manner, i.e., in a twisting direction generally lengthwise of the hinge 92, to thereby expose the adhesive portion 94 at the upper side of section 90.

A photograph or analogous sheet-like article may now be manually pressed against and thereby adhere to the exposed adhesive portion 94. It will be evident that the border region of either the rear or the front side of the photograph may be mounted on adhesive portion 94. Of course, the same option is also available for all of the earlier mentioned embodiments.

Figure 15:
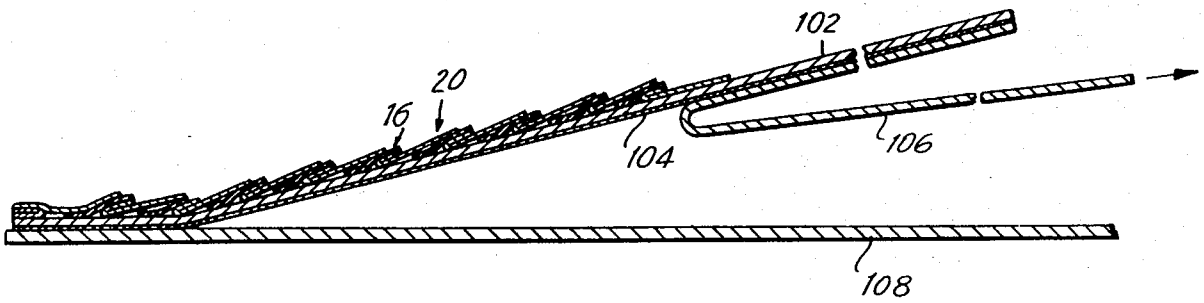
FIG. 15 is a cross-sectional view of an adhesive-backed backing member diagrammatically showing the removal of a protective cover sheet and the attachment of the backing member to an album.

Referring to FIG. 15, the backing member 102 has a lower major surface on which an adhesive coating 104, such as a pressure-sensitive adhesive is located. The protective cover or strip sheet 106 is normally in adhesive contact with the adhesive coating 104. Once a user decides to mount the backing member on to an album page 108, the cover sheet 106 is separated from backing member 102 by pulling the cover sheet 106 off the adhesive layer 104. It will be understood that the adhesive bond between the adhesive coating 104 and the cover sheet is less than the adhesion bond between the adhesive layer 104 and the backing member 102. FIG. 15 diagrammatically shows the cover sheet partially stripped off the backing member 102, and an album page partially attached to the adhesive coating 104. Any one of the aforementioned embodiments of the strip and ribbon pair combinations may be provided on the upper major surface of the backing member 102.

It will be understood that each of the elements described above, or two or more together, may also find a useful application in other types of constructions differing from the types described above.

While the invention has been illustrated and described as embodied in an Album, it is not intended to be limited to the details shown, since various modifications and structural changes may be made without departing in any way from the spirit of the present invention.

If desired, the extensions 20*d*, 40*b* and 55*b* of ribbons 20, 40, 55, respectively, could be omitted and the ribbons in such case could be peeled off.

As mentioned previously, the adhesive-free wedge-shaped space is used to locate an edge of a photographic snapshot positive in a predetermined position for mounting; but such predetermined positioning only relates to the edge of the snapshot positive that engages the apex of the wedge-shaped space. It also is desirable in the pursuance of the present invention to make all four edges of the snapshot positive assume predetermined positions; this will provide neatness, symmetry and regularity to a group of snapshot positives mounted on a single backing member with the asstance of a single group of parallel mounting strips 16.

Quite apparently, the location of one edge of a snapshot positive against the apex of a wedge in predetermined position will assure a predetermined position of the parallel opposite edge of the snapshot positive. However, the edges of the snapshot positive perpendicular to the aforesaid edges (for convenience the perpendicular edges will be referred to as the "lateral" edges) may be in different undetermined random positions. It would be highly desirable if the lateral edges were disposed symmetrically with respect to the vertical center of the plurality of strips 16 and moreover were aligned with one another (colinear) at each of the strip.

Figure 16:
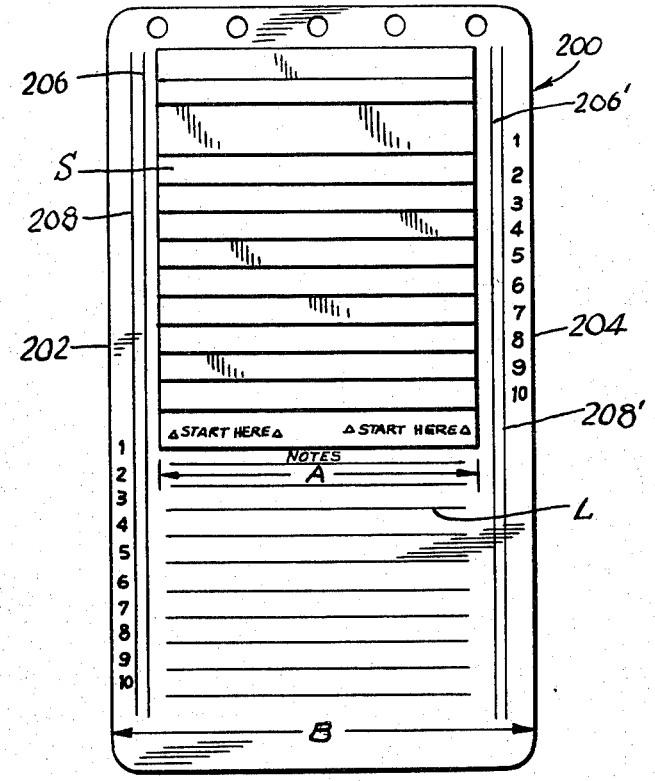
FIGS. 16 and 17 are plan views of album pages showing different forms of the invention.
Figure 17:
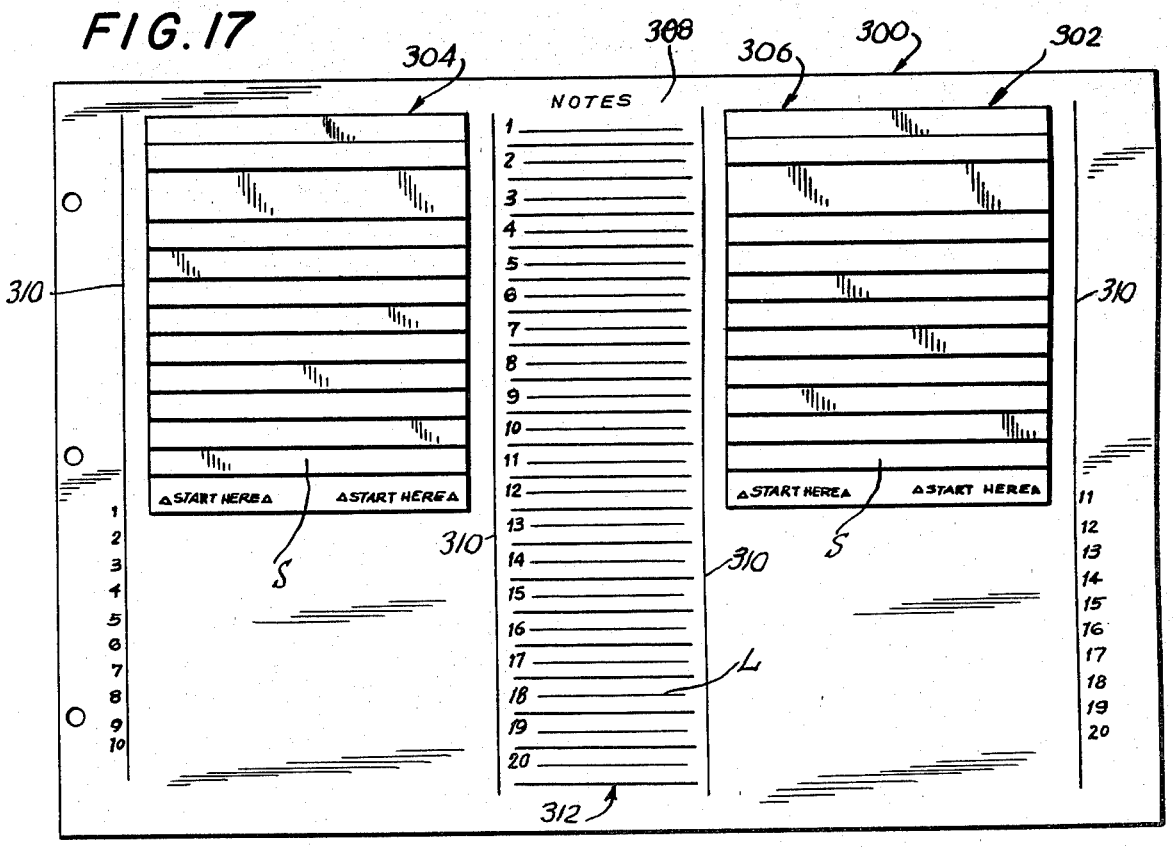

FIGS. 16 and 17 show two different forms of the invention in which this desirable relationship is obtained.

Referring to FIGS. 16, the reference number 200 denotes a backing member, i.e. an album page, having a plurality of hinged mounting strips S secured thereto. Each strip has adhesive areas and a strippable ribbon. Anyone of the various forms of hinged mounting strips shown in the preceding figures and described with resepct thereto can be employed with the backing member 200. For example the strip S, adhesive and ribbons exemplificatively may be the same as shown in and described with respect to FIGS. 1 through 8.

In order to locate the lateral edges of mounted snapshot positives in predetermined positions and in mutual vertical alignment, rectilinear guide areas are provided. Such guide areas constitute, for example, the lateral straight parallel edges 202, 204 of the backing member. The strips S are oriented perpendicularly to the edges 202 and 204. The lengths of the strips S, i.e. their lengths perpendicular to the edges 202, 204, are, according to this aspect of the invention, so selected that the lateral edges of the strips themselves can act as linear guides.

To understand the use of the feature under discussion note should be taken that standard snapshot positives, as furnished to the public, conventionally are of certain predetermined standard sizes. Typical sizes are listed below.

| FILM NUMBER | SIZE (IN INCHES) |
|---|---|
| 126 | 3½" × 3½" |
| 110 | 3½" × 4½" |
| 135 | 3½" × 5" |
| Polaroid SX-70 | 3½" × 4" |
| Kodak PR-10 | 4" × 4" |

Advantage is taken of the prefixed standards in connection with the present invention. Thus the width A of a group of strips is selected to match one dimension of some given size of snapshot positive. This may be and preferably is a dimension that is common to snapshot positives of more than one size. As as example, the width of a group of strips is made equal to 3½". This dimension is that for No. 126 snapshot positives. It also is a dimension for No. 110 and for No. 135 snapshot positives and for Polaroid SX-70 snapshot positives. When any of these snapshot positives are used with a group of strips S having the just mentioned common width of 3½", all can have their lateral edges registered with the lateral edges of the strips so that the lateral edges of all the snapshot positives will be mutually vertically aligned, whereby symmetry and neatness will be obtained.

The backing member and group of strips furthermore can be used to accommodate snapshot prints of different sizes. This feature of my invention usually is so arranged as to accommodate only photographs of two different sizes, however, if desired said feature can be designed to allow the mounting of three, four or even more sizes of photographs.

Conveniently, although not necessarily, all of the snapshot positives mounted in a group of posiitives depending from a set of hinged mounting strips are so arranged that a long edge of each of the snapshot prints is received in a wedge-shaped apex of the associated pocket of the hinged mounting strip. Different sizes of snapshot positives as mentioned above are either square or oblong. Where a group of strips is 3½" from lateral edge to lateral edge, i.e. the dimension A is 3½", an edge of a snapshot positive having the 3½" dimension would be inserted in the wedge of the pocket in which case the other edges at right angles to the inserted edge will be parallel to the side edges of the album page, in the illustrated example the edges 202, 204.

If the snapshot positive is No. 126 and the dimension A is 3½" the guide lines for the lateral edges of the positive will be the side edges i.e. the lateral edges, of the strips. However if the snapshot positives are, for example, PR-10's either the strips would have a dimension A equal to 4" or a further (second) set of guide lines are provided.

In FIG. 16 there are shown such further guide lines, these being identified by the reference numerals 206, 206' 208 and 208' (in addition to the lateral edges 202, 204 which serve as guide lines). For example the spacing between the guide lines 206, 106' is made 4" in order to aid in aligning the lateral edges of PR-10 snapshot positives and the distance between the parallel guide lines 208, 208' is made 4½" to function as guide lines for 110 snapshot positives. The distance B between the lateral edges 202, 204 is made 5" to serve as lateral guide lines for the lateral edges of No. 135 snapshot positives. Alternatively an additional set of guide lines may be provided for the No. 135 snapshot positives, i.e. a physically separate set of parallel lines. Although not specifically stated heretofor, each of the pairs of guide lines should be rectilinear, parallel to the lateral edges of strips and preferably equidistantly spaced from the lateral edges of the strips so that a set of the snapshot positives mounted on the strips will be symmetrical with respect to the vertical center of the set of strips.

In the space below the lowermost strip of the set of strips a blank space formed between the innermost pair of guide lines 206, 206;. This space may be employed to write notes identifying various facets of the snapshot positives, as for example the date the snapshot positive was taken, the exposure parameters (aperture and shutter speed), the place where the snapshots were taken, the persons shown, etc. For this purpose lines L are imprinted on the album page parallel to the lower edge of the lowermost strip and spaced apart a sufficient distance vertically to permit writing on the lines. In addition, cross references, i.e. corrolation, numbers may be imprinted, for instance in the margin alongside each strip near its lateral edge and on the backing member alongside each line. Thus, the number 1 may be imprinted next to the uppermost strip and the uppermost line. The number 2 will be similarly imprinted next to the next cover strip and line, etc.

In FIG. 17 an album page 300 embodying a variation of the FIG. 16 arrangement of the strips and of the notes is shown. This page 300 constitutes a backing member 302 having two sets 304, 306 of strips S mounted thereon in side by side spaced parallel transversely registered relationship, leaving a space 308 between them. The individual sets of strips S are the same as described with reference to FIG. 16. However the lateral edge of the page 300 cannot serve as guide lines. Instead guide lines 310 are provided on each side of sets 304, 306 of strips. The guide lines serve the same purpose as described with respect to the guide lines of FIG. 16. Instead of having note lines below each set of strips, note lines 312 are imprinted on the album page 300 in the space 308 between the strips 304, 306. Each strip of the two sets of strips may have identification numbers printed in the space along side the strips and corresponding numbers are printed along side each of the note lines. The numbers on either set of strips will follow in sequence after the last number on the other set of strips to avoid confusion. Instead of having identification numbers for the strips printed in the margin along side each strip as shown with respect to the form of the invention illustrated in FIG. 16, the identification numbers may be printed below the strips in the margin as shown in FIG. 17, being disposed near the top edge of the snapshot print being identified thereby.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An album for displaying sheet-like articles such as photographs and the like, comprising:

(a) an imperforate backing member having opposite major surfaces;

(b) at least one elongated rectilinear strip arranged on only one of said surfaces of said backing member, said strip including (i) a stationary rectilinear section in fixed position on only said one backing surface, (ii) a movable rectilinear section in one piece with said stationary section and having opposite surfaces, and (iii) rectilinear hinge means interposed between said sections and operative for swinging the movable section relative to the stationary section about a rectilinear folding axis which extends lengthwise of the strip intermediate said sections between a display position in which one side of the sheet-like article is displayed, and a flipped-over position in which the opposite side of the sheet-like articles is displaced, said movable section being free of the surface of the backing member (c) means firmly anchoring said stationary section on said only one surface of said backing member against a pulling removal force of a predetermined magnitude;

(d) adhesive means on the surface of said movable section which faces the backing member, said adhesive means being adhered to said one surface of said movable section against a pulling removal force of a given magnitude;

(e) a pull ribbon associated with and adjacent to said rectilinear strip, said pull ribbon including (i) a peel-off section adhered to said one surface of said movable section on which said adhesive means is present, said peel-off section being adhered to said adhesive means against a pulling removal which is of a magnitude less than said predetermined and said given magnitudes, respectively, and (ii) a handle section connected to and extending beyond said peel-off section and beyond said adhesive means, said handle section being manually grippable so that a user may grasp and pull said handle section to peel the peel-off section from the movable section, without pulling the strip off said backing member, and without detaching said adhesive means from said one surface of said movable section, to thereby expose said adhesive means on said one surface of said movable section and permit a user to manually attach to said freshly exposed adhesive means the sheet-like article to be displayed in either of said positions, (f) said adhesive means being substantially completely covered by said peel-off section, (g) said movable section, said peel-off section and said handle section being close to and spaced from said backing member, having substantially no exposed adhesive means, and forming a rectilinear wedge-shaped adhesive-free pocket defined by said backing member and said pull ribbon into which said sheet-like article may be freely inserted for positioning by placement of an edge of the article against the bottom of said pocket before the peel-off section is removed and the sheet-like article is adhered to the adhesive means, the adhesive means on the movable section being substantially exposed for adhesion to the article without movement of the article by peeling off the peel-off section.

2. The album as defined in claim 1, wherein there are plural strips and ribbons and wherein each strip and ribbon associated with the latter are spaced at a distance remote from the next successive strip and its associated ribbon such that each respective strip and ribbon do not overlap the next successive strip and ribbon in either of said positions.

3. The album as defined in claim 1, wherein said adhesive means is a pressure-sensitive adhesive.

4. The album as defined in claim 1, wherein the pull ribbon is folded to define two coextensively extending segments, one of the segments being the peel-off section and the other segment being the handle section, the two segments being interconnected adjacent the apex of the pocket, and the handle section being interposed between the peel-off section and the backing member.

5. The album as defined in claim 1 wherein plural rectilinear strips with their lateral edges aligned are provided on said one surface of the backing member and wherein the backing member includes a pair of rectilinear guide areas located equidistantly laterally of the centers of the strips to assist in symmetrically locating the lateral edges of snapshots perpendicular to the edges of the snapshots received in the wedge-shaped pockets against the bottoms of the pockets.

6. The album as defined in claim 5 wherein the rectilinear guide areas are the algined lateral edges of the plural strips.

7. The album as defined in claim 5 wherein the rectilinear guide areas are lines parallel to and spaced equally outwardly from the aligned lateral edges of the plural rectilinear strips.

8. The album as defined in claim 7 wherein more than one pair of lines is provided.

9. The album as defined in claim 5 wherein plural sets of rectilinear strips with their lateral edges aligned are provided side by side on the backing member with a space therebetween.

10. The album as defined in claim 5 wherein plural lines are provided on the backing member below the lowermost strip of the plural rectilinear strips, said lines being adapted to assist in the inscription of notes relating to the snapshots mounted on the strips.

11. The album as defined in claim 9 wherein plural lines are provided between the two sets of strips to assist in the inscription of notes relating to the snapshots mounted on the strips.

12. An album for displaying sheet-like articles such as photographs and the like, comprising:

(a) a backing member having opposite major surfaces;

(b) plural elongated rectilinear strips arranged on one of said surfaces of said backing member, each of said strips constituting a hinged mounting member including a stationary rectilinear section in fixed position on said surface, a movable section in one piece with said stationary section and rectilinear hinge means interposed between said sections and operative for swinging the movable section relative to the stationary section about a rectilinear folding axis which extends lengthwise of the strip intermediate said sections;

(c) means firmly anchoring said stationary sections on said surface;

(d) adhesive means on one of the surfaces of said movable sections to mount a snapshot;

(e) the lateral edges of said strips being aligned; and (f) rectilinear guide lines on the backing member located equidistantly laterally of the centers of the strips to assist in symmetrically locating the lateral edges of snapshots perpendicular to the lengths of said strips.

13. The album as defined in claim 12 wherein plural lines are provided on the backing member in association with the plural rectilinear strips for inscription of information relevant to the snapshots mounted on the strips.

14. The album as defined in claim 13 wherein reference symbols are provided in association with each strip and similar reference numerals are provided in association with each of the lines for cross identification thereof.

* * * * *